US008707660B2

(12) United States Patent
Howes

(10) Patent No.: US 8,707,660 B2
(45) Date of Patent: Apr. 29, 2014

(54) PACKAGING SYSTEM AND METHOD

(75) Inventor: Neville Howes, Suffolk (GB)

(73) Assignee: Dubble Bubble Limited, Wetherden Stowmarket Suffolk (GB)

( * ) Notice: Subject to any disclaimer, the term of this patent is extended or adjusted under 35 U.S.C. 154(b) by 0 days.

(21) Appl. No.: 13/511,444

(22) PCT Filed: Nov. 16, 2010

(86) PCT No.: PCT/IB2010/055183
§ 371 (c)(1), (2), (4) Date: May 23, 2012

(87) PCT Pub. No.: WO2011/064689
PCT Pub. Date: Jun. 3, 2011

(65) Prior Publication Data

US 2012/0269459 A1 Oct. 25, 2012

(30) Foreign Application Priority Data

Nov. 27, 2009 (GB) ..... 0920815.8

(51) Int. Cl.
*B65B 9/08* (2012.01)

(52) U.S. Cl.
USPC ..... 53/450; 53/550; 53/551; 53/170; 53/432; 53/434; 53/449; 53/451; 53/459

(58) Field of Classification Search
USPC ..... 53/170, 545, 548, 550–551, 553–555, 53/449–452, 469, 472, 432, 510, 511, 53/370.7, 375.9, 434, 459; 206/522
See application file for complete search history.

(56) References Cited

U.S. PATENT DOCUMENTS

| | | | | | |
|---|---|---|---|---|---|
| 2,154,521 | A | * | 4/1939 | Maxfield | 53/449 |
| 3,038,593 | A | | 6/1962 | Root et al. | |
| 3,340,669 | A | * | 9/1967 | Farquharson | 53/455 |
| 3,889,446 | A | * | 6/1975 | Simmons et al. | 53/451 |
| 4,240,556 | A | * | 12/1980 | Field | 206/522 |
| 4,267,684 | A | | 5/1981 | Ambrose | |
| 4,434,893 | A | * | 3/1984 | Barlow | 206/522 |
| 4,495,748 | A | * | 1/1985 | Rowell | 53/449 |

(Continued)

FOREIGN PATENT DOCUMENTS

| | | |
|---|---|---|
| EP | 0306207 | 3/1989 |
| EP | 1787912 | 5/2007 |

(Continued)

OTHER PUBLICATIONS

PCT Search report of PCT/IB2010/055183 (Parent Case), Mailed Apr. 6, 2011.
PCT Search opinion of PCT/IB2010/055183 (Parent Case), Mailed Apr. 6, 2011.
PCT Preliminary Report on Patentability of PCT/IB2010/055183 (Parent Case), Issued May 30, 2012.
Informal Comments by Applicant on WO—ISA of PCT/IB2010/055183 (Parent Case), submitted to WIPO on Apr. 28, 2011.

(Continued)

*Primary Examiner* — Christopher Harmon

(57) ABSTRACT

A package for an article (1) comprises a pressurized outer bag (5) having gas-tight seals (7) at opposite ends, and an inner web for supporting the article within the outer bag. The web extends along the length of the outer bag and is secured to the outer bag only at the gas-tight seals (7). The web is maintained under sufficient tension by the pressure within the outer bag to suspend the article within the bag and to maintain a space between the article and the outer bag on all sides of the article.

21 Claims, 4 Drawing Sheets

(56) References Cited

U.S. PATENT DOCUMENTS

| | | | | |
|---|---|---|---|---|
| 4,681,228 | A * | 7/1987 | Kerry et al. | 206/484 |
| 5,272,856 | A * | 12/1993 | Pharo | 53/472 |
| 5,487,470 | A | 1/1996 | Pharo | |
| 6,435,348 | B1 | 8/2002 | Pasquesi | |
| 7,681,377 | B2 * | 3/2010 | Simmons et al. | 53/451 |
| 7,726,098 | B2 * | 6/2010 | Doll | 53/412 |
| 8,146,332 | B2 * | 4/2012 | Slovencik | 53/553 |
| 8,202,024 | B2 * | 6/2012 | Simmons et al. | 405/259.6 |
| 2003/0024846 | A1 | 2/2003 | Nadler | |
| 2006/0062949 | A1 | 3/2006 | Hanaichi et al. | |
| 2008/0274239 | A1 * | 11/2008 | Doll | 426/119 |

FOREIGN PATENT DOCUMENTS

| | | |
|---|---|---|
| GB | 526148 | 9/1940 |
| JP | H10329869 | 12/1998 |
| WO | WO0200502 | 1/2002 |

OTHER PUBLICATIONS

British patent application GB1019336.5 entitled "Packaging system and method" (which matured into patent GB2475770)—Application As Filed on Nov. 16, 2010—York, UK.

British patent application GB1019336.5 entitled "Packaging system and method" (which matured into patent GB2475770)—UKIPO Search/Examination Report mailed on Dec. 23, 2010—Newport, South Wales, UK.

British patent application GB1019336.5 entitled "Packaging system and method" (which matured into patent GB2475770)—Applicant response to UKIPO Search Report—dated May 12, 2011—York, UK.

British patent application GB1019336.5 entitled "Packaging system and method" (which matured into patent GB2475770)—UKIPO Examination Report mailed on Jul. 15, 2011—Newport, South Wales, UK.

* cited by examiner

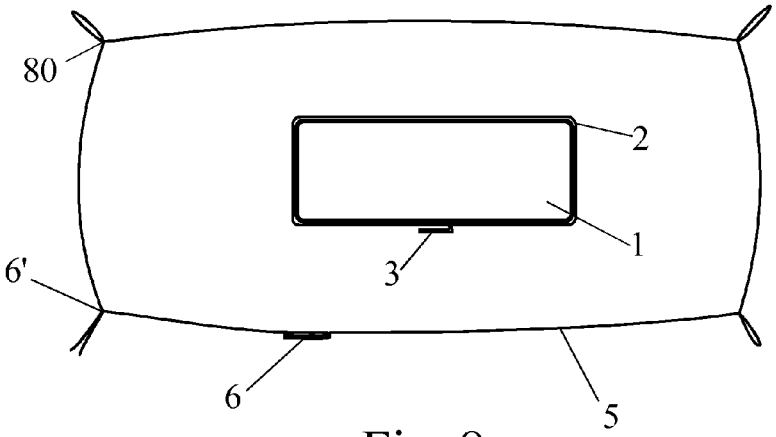
Fig. 8
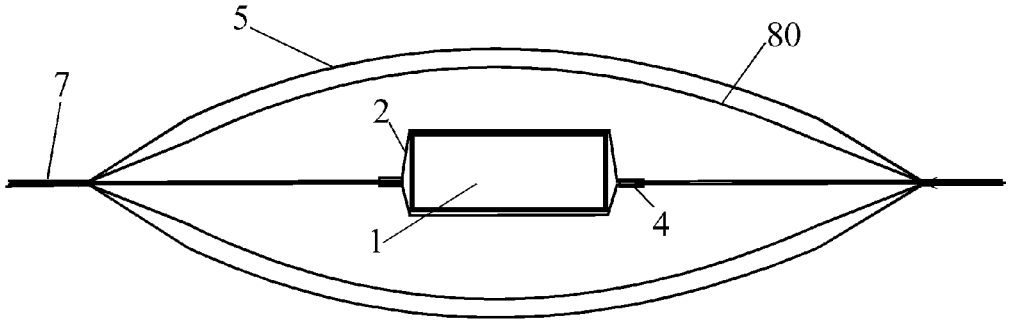
Fig. 9
Fig. 10
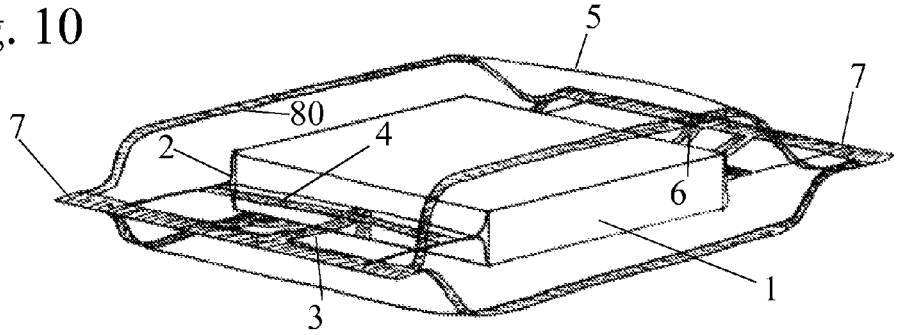

PACKAGING SYSTEM AND METHOD

This Application is a national phase of, and claims priority from, PCT Application No. PCT/IB2010/55183, filed on Nov. 16, 2010, which claims priority from GB 0920815.8, filed on Nov. 27, 2011.

FIELD OF THE INVENTION

This invention concerns a flexible package that may be used for packaging solid or liquid products and may be manufactured on automated production machinery.

BACKGROUND OF THE INVENTION

Packaging of products serves several functions, including protecting the contained item from contamination or deterioration, and minimising mechanical damage during handling or transport.

Packaged items are often sealed within a pouch, for example a vacuum pack or a blister pack. However, depending on the packaging material, such sealed pouches may not provide sufficient mechanical protection. Conventionally, this problem is addressed by increasing the thickness or rigidity of the sealed pouch. Additionally or alternatively, the sealed pouch may be cushioned by surrounding material, such as bubble wrap, corrugated card or expanded foam material, for example.

However, these and other methods of protection tend to increase the bulk or weight of the package or a consignment of packages, and thereby increase costs and waste along the supply chain.

SUMMARY OF THE INVENTION

In accordance with a first aspect of the invention, there is provided a package for an article comprising a pressurised outer bag having gas-tight seals at opposite ends, and an inner web for supporting the article within the outer bag, wherein the web extends along the length of the outer bag and is secured to the outer bag only at the gas-tight seals, and wherein the web is maintained under sufficient tension by the pressure within the outer bag to suspend the article within the bag and to maintain a space between the article and the outer bag on all sides of the article.

In the invention, the packaged articled is held in suspension within a sealed inflated bag and is in this way protected against mechanical impact.

In a preferred embodiment of the invention, the inner web is wrapped around the article and sealed to form an inner pouch within the outer bag. By providing an inner pouch within the outer protective bag, this embodiment of the invention can be used to package liquids as well as solid articles. A further advantage of such an embodiment of the invention is that the pouch may be evacuated or filled with an inert gas or gaseous mixture, as may be desirable to prolong the shelf life of certain articles such as foodstuffs.

The outer bag may itself be pressurised with an inert gas or gaseous mixture.

An outer bag formed from a flat sheet that is drawn from a reel and made into a tubular sleeve by means of a hermetic back seal will be generally pillow shaped with a rounded cross section, but to improve the stackability of packages and offer additional protection, the outer bag may include longitudinally extending welded pinches to impart a cusped cross section to the outer bag.

Embodiments of the invention can thus be seen to provide an integrated pack that protects and cushions a product, while reducing extraneous packaging material. The pack can be produced on a range of automatic packaging machinery or from pre-made pouches.

According to two further aspects, the invention provides a method as set forth in claim 6 of the appended claims and a packaging machine as set forth in claim 12 of the appended claims.

The term "pouch" as used herein is intended to include any receptacle, cavity or wrapping surrounding and containing a liquid or solid item.

Especially when a number of packages are produced on automated or semi-automated machinery, those portions of the pouch adhering to the outer bag are sealed thereto in substantially the same manner as the pouch is sealed. Ideally, each sealed portion comprises substantially the whole of the relevant edge of the inner pouch. By "seal" is meant substantial integration of the material or materials contacting each other. Depending on the package requirements, all seals should be substantially hermetic, at least for the expected lifetime of the package.

In accordance with known practice, the inner web may be a pouch containing a vacuum. Depending on the degree of evacuation required, this may be a hard or soft vacuum. Conveniently, the pouch may be flushed with an inert gas or mixture of inert gases before sealing to ensure that any residual gas within the inner pouch is modified to be substantially unreactive in relation to the contents of the inner pouch, at least for the expected lifetime of the package. Preferably, the residual gas is substantially oxygen-free.

The outer bag may be pressurised with air or any inert gas or mixture of gases. Carbon dioxide and nitrogen are convenient and readily available.

The inner web or pouch and the outer bag may be made of the same or different materials, provided that they can be sealed or otherwise adhere to each other. The inner pouch and the outer bag may be substantially gas tight, taking account of the applicable pressure differentials. Materials to produce both the inner web/pouch and outer bag can each be tailored to the varied requirements of the products contained. To this, a wide range of flexible packaging materials may be utilised. Examples of suitable materials are:

1. Recyclable materials such as Mono or co-extruded Polyethylene- and Mono Polypropylene-based flexible materials.
2. Co-extrusions of (for example) Polyethylene/Nylon/Polyethylene, where oxygen barriers may be incorporated in the co-extrusion.
3. Two layer laminates of Oriented Polypropylene/modified Polyethylene (sealing compatible to the OPP).
4. Three or more layer laminates of (for example) Polyethylene/Polyester/Polyethylene.

Embodiments of the invention may allow the potential replacement of several current packaging systems offering product protection methods that are more energy hungry in their construction and manufacture. The package uses air or an inert gas as the protective medium rather than rigid or semi-rigid constructions such as: blister pack materials (amorphous polyethylene terephthalate, polyvinyl chloride etc); polystyrene; carton and corrugated board; or cellulose acetate propionate food packs ((amorphous) polyethylene terephthalate/polyethylene). The invention may thus be environmentally friendly.

The invention allows lower weight flexible packaging materials to be tailored to the exact oxygen and barrier requirements of the product. It may be possible to enable significant reductions in the total weight of packaging material required and in the carbon footprint resource.

The invention also offers the potential to use recycled materials in its construction and to use recyclable materials to pack many non-oxygen sensitive products.

Some embodiments of the invention may enable continuous assembly of packages by modifying existing machines.

The description below relates to a preferred embodiment in which the inner web is formed as a sealed inner pouch.

When produced in Horizontal Form Fill & Seal form, the package is produced by folding a flexible material around a product horizontally and sealing together the two edges of the folded material by means of a back seal, before pulling a soft vacuum around the product if required. The product is then enclosed within the flexible material and end seals applied to seal substantially across the axis of the back seal, so that the product is gently restrained inside the pouch.

At this point the flexible material is not cut, and the material now encasing the product continues to a second stage on the machine, where a wider material is formed around the inner pouch. A back seal is made to the outer material before an overpressure of either air or mixed gases is blown into the package to inflate the outer bag, before end seals are applied. Only at this stage is the outer bag sealed to the inner pouch and only through the end seals of the outer bag. The inner pouch is therefore held in suspension within the outer bag, protecting it within a cushion of air or mixed gases. The pressure within the outer bag serves to tension the inner pouch suspending the inner pouch clear of the walls of the outer bag. The inner pouch may be gas flushed before sealing, and a mixture of gases may be used to inflate the outer bag when a controlled atmosphere is desirable.

When produced in Vertical Form Fill & Seal form, the package is produced by forming a flexible material around a product vertically and sealing a back seal to the material, before pulling a soft or hard vacuum around the product if required. The product is then enclosed within the flexible material and end seals applied so that the product is held within an inner pouch, which may contain a vacuum. At this stage the pouch remains uncut, and the material now encasing the product continues to the second stage of the machine, where a wider material is formed around the inner pouch. A back seal is applied to the outer material before an overpressure of either air or mixed gases is blown into the pack to inflate the outer bag before an end seal is applied. The inner pouch is therefore held in suspension within the outer bag, the two packs being sealed together through the end seals only and with the outer bag protecting the inner pouch within a cushion of air or mixed gases. The inner pack may be gas flushed before sealing, and a mixture of gases may be used to inflate the outer bag when a controlled atmosphere is desirable When producing the package in-line from Vacuum Forming machinery, the inner pouch is produced by thermoforming a bottom layer of material in a conventional way, with the product then being inserted into the formed cavity, before a top web of material is sealed to the base web. If required, a hard or soft vacuum may be pulled around the product in the conventional manner of vacuum forming machinery. The side trims are then removed but the end seals are however not cut at this stage. The material encasing the product continues to a second stage on the machine or a second filling machine, where it enters a horizontal form fill and seal section forming a larger outer bag around the inner vacuum-formed pack. A wider material encases this inner pouch and a back seal is made to the outer material before an overpressure of either air or mixed gases is blown into the pack to inflate the outer bag before the end seals are applied. A mixture of gases may be applied when a controlled atmosphere is desirable. As previously, the inner pouch is held in suspension within the outer bag, the two packs being sealed together through the end seals only and with the outer bag protecting the inner pouch within a cushion of air or mixed gases.

BRIEF DESCRIPTION OF THE DRAWINGS

The invention will now be described further, by way of example, with reference to the accompanying drawings, in which:

FIG. 8 is a transverse section through an alternative packaging embodying the invention, FIG. 9 shows the packaging of FIG. 8 as viewed from the side, and FIG. 10 shows a perspective view of the packaging of FIGS. 8 and 9.

DETAILED DESCRIPTION OF THE PREFERRED EMBODIMENT(S)

Figure 1:
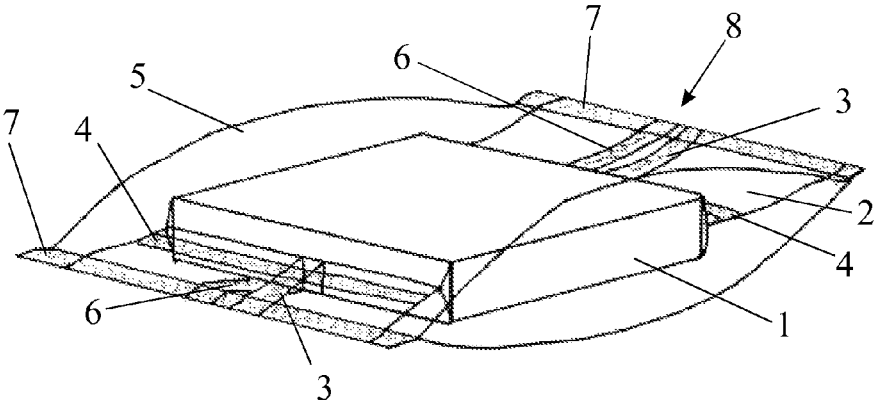
FIG. 1 is a drawing of the finished package profile for both horizontal and vertical production methods.

In FIG. 1, the product to be packaged is designated 1. An inner pouch 2 is formed by wrapping an inner web around the product 1, and creating a back seal 3 and inner end seals 4 allowing the product to be gently restrained within the inner pouch and held in a vacuum if required. An outer material 5 is wrapped around the inner pouch 2 with an over pressure being trapped inside the pack by virtue of a back seal 6 and end seals 7, hermetically sealing the material together. The final pack end seal 7 seals the material of the inner pouch 2 to the outer material 5, thus allowing the product 1 to be held in suspension within a cushion of air or mixed gases. The region of the end seal 7 designated 8 shows that the back seals 3 and 6 of the inner pouch 2 and the outer bag 5, are laterally offset from one another to reduce the potential of over pressure loss through pinholing or piping.

Figure 2:
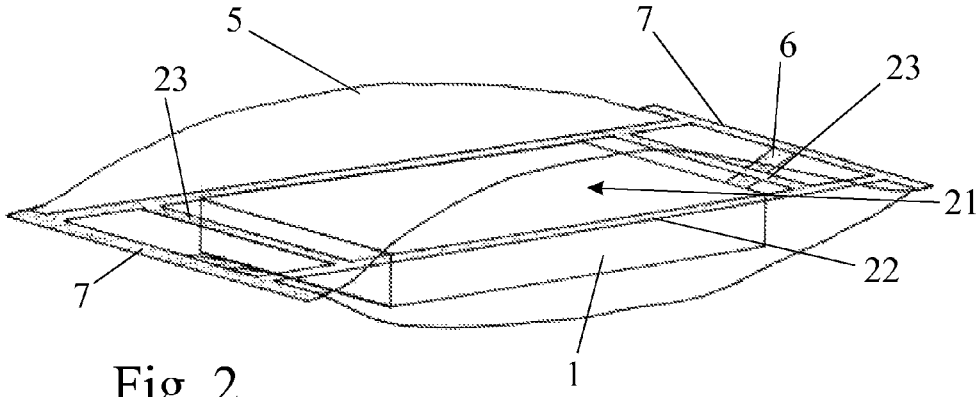
FIG. 2 shows the finished package where the inner pouch is produced from a vacuum forming machine adapted to run in-line through a horizontal form fill and seal machine (see FIG. 7)

In FIG. 2, the product is again designated 1. 21 indicates the inner vacuum-formed pack produced from a conventional top and base web with side seals 22 and the end seals 23 applied to the inner pouch 21 to include a vacuum, if required, around the product 1 before the sealing is applied. The outer bag inflated with air or a mixture of gases is shown at 5, with the outer horizontal form fill and seal pack being sealed along a back seal at 6 and the end seals 7 being applied to seal the outer material. The final pack end seals 7 seal the inner material 21 to the outer material 5, thus allowing the product 1 to be held in suspension within a cushion of air or mixed gases.

Figure 3:
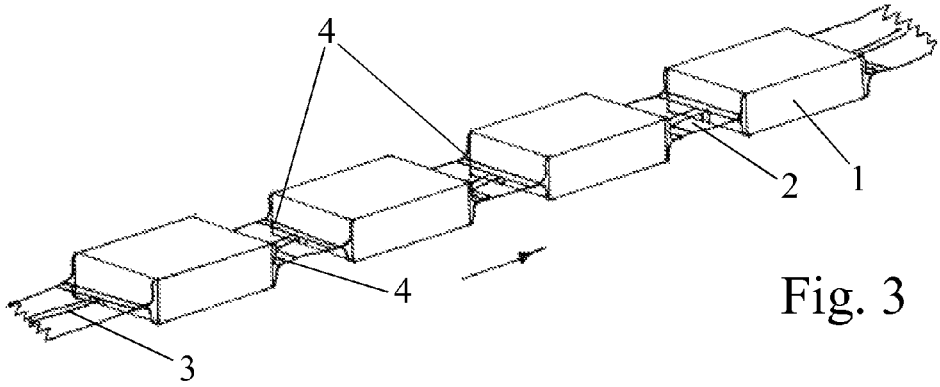
FIG. 3 is a drawing of uncut but sealed and vacuumed pouches after the first stage of production in both the horizontal form fill and seal version (see FIG. 5) and the vertical form fill and seal version (see FIG. 6)

In FIG. 3, 1 is the product and 2 shows the inner web sealed around the product by means of a back seal 3 and end seals 4. The drawing shows the completed but uncut inner pack before entering the second stage where the outer bag is applied, inflated and sealed.

Figure 4:
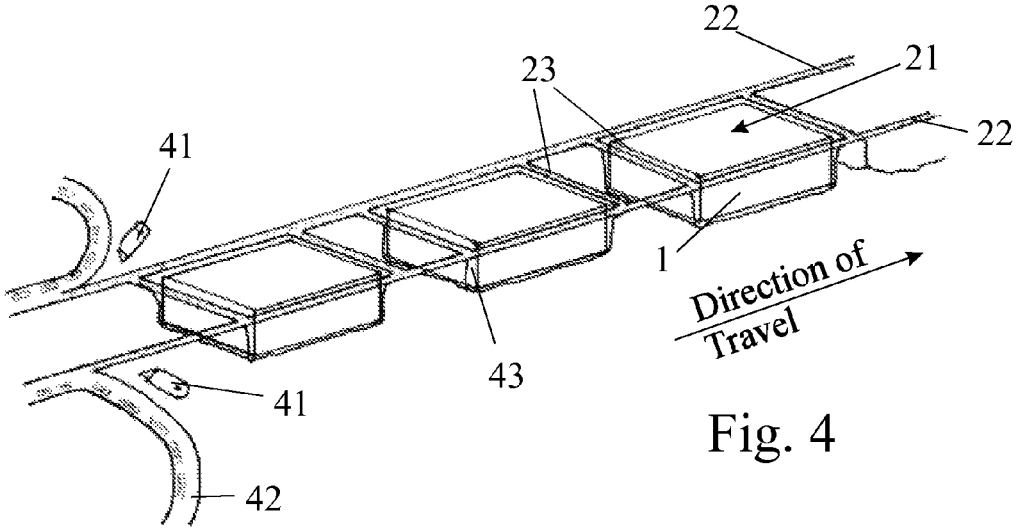
FIG. 4 is a drawing of uncut but sealed and vacuumed pouches after the first stage of production in the vacuum forming/Horizontal form fill and seal version (see FIG. 7)

In FIG. 4, 1 is the product held in a soft or hard vacuum, if required, and sealed within a formed cavity after leaving the vacuum forming stage of providing the first (inner) pouch 21. 41 shows the knives that remove the reel edge trim 42 from both sides of the material. Side seals 22 have been made in the machine direction to seal the top web to the bottom web and cross seals 23 have been made to encapsulate the product after it may have been gas flushed and held in a soft or hard vacuum. 43 shows the formed base web cavity around the product, which may have been gas flushed with a mixture of gases if required before vacuuming and sealing the inner pouch 21.

Figure 5:
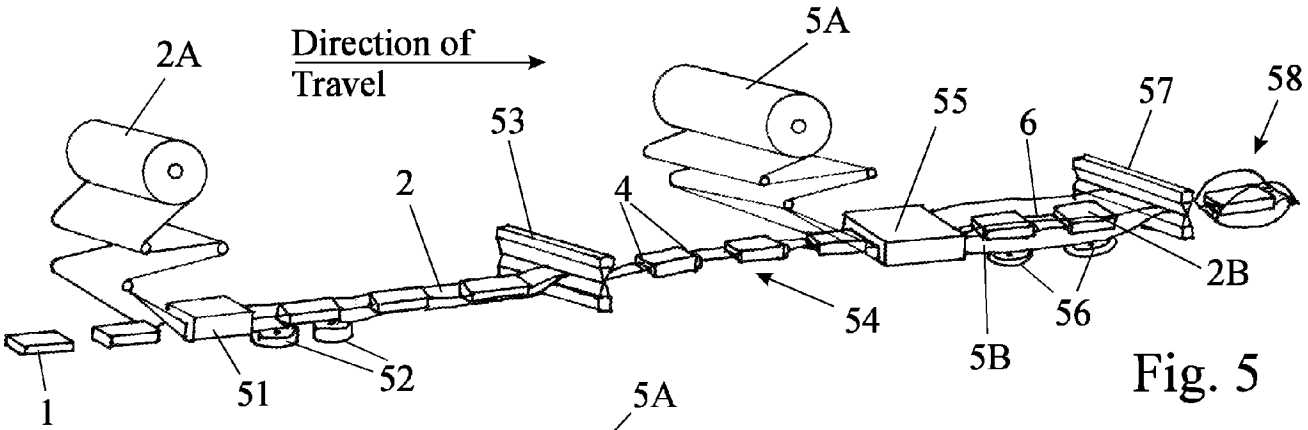
FIG. 5 shows the principle of production using horizontal form fill and seal machinery.

In FIG. 5, 1 is the product on a supporting conveyor (not shown) entering the machine and 2A is the reel of material to form the inner pouch 2. The material is wrapped around the product in the forming box 51 and a fin or lap back seal applied by either heated rollers or heated pads 52 to produce a back seal (see FIG. 3, seal 3). Within this stage the product may be gas flushed if required before a vacuum, if required, is applied around the product by means of a conventional vacuum lance (not shown) and the end seals 4 formed at a heated station 53. The uncut vacuum packs indicated at 54 then move along a supporting conveyor (not shown) to the secondary forming box 55 where an outer reel of material 5A is formed around the inner pack 2. A fin or lap back seal is then applied by either heated rollers or heated pads 56 to produce a back seal 6 in any suitable position which seals the outer material 5A only to itself. The outer material is not attached to the inner pack. 2B shows the inner pouch still held in suspension within the outer wrap and 5B the outer bag inflated with either air or a mixture of gases, such as carbon dioxide or nitrogen. The outer bag is then sealed as shown at 57, with the inner and outer bags also being sealed together at 57 before being cut into individual packages. 58 indicates the finished individual packages leaving the production machine (see also FIG. 1).

Figure 6:
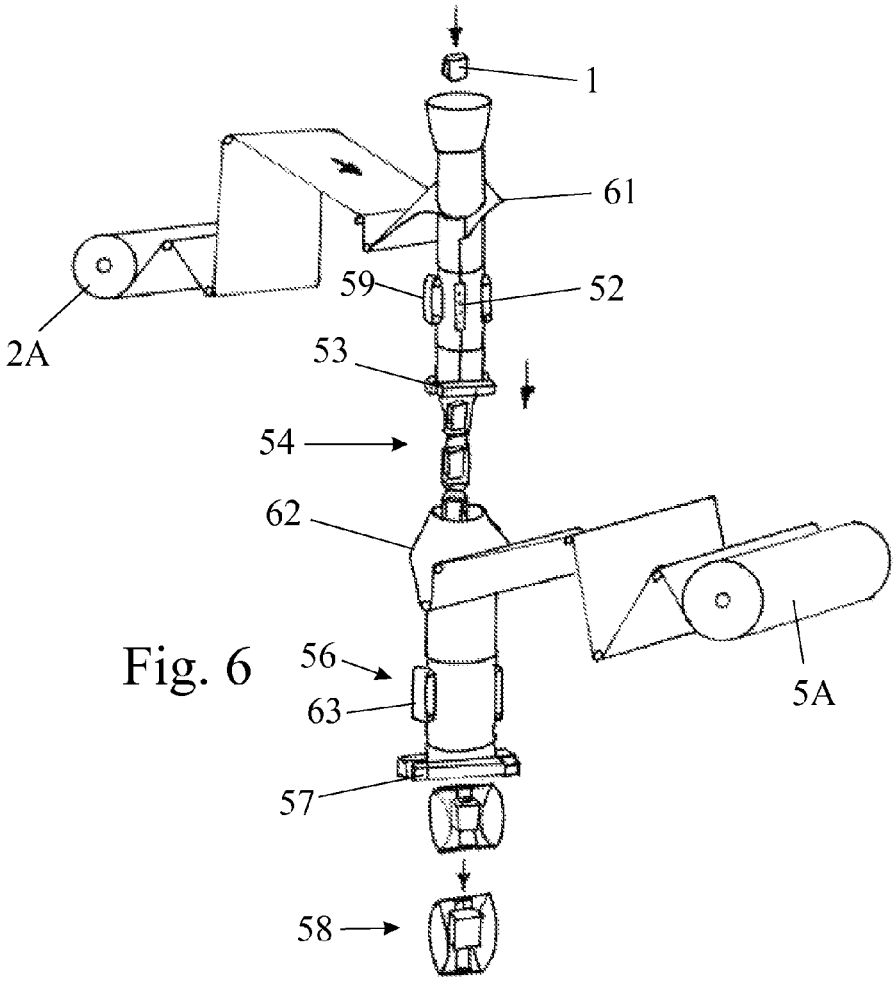
FIG. 6 shows the principle of production using vertical form fill and seal machinery.

In FIG. 6, 1 is the product being dropped vertically. 2A shows a reel of material to form the inner pouch being formed around a forming collar at 61. The material is then pulled or driven by conventional methods, such as a moving belt or reciprocating jaws 59, with a fin or lap back seal being applied at 52. The inner pouch may at this stage be gas flushed with a mixture of gases before a vacuum is applied around the product, if required, and the pouch is end-sealed at 53. 54 indicates the uncut inner pouches continuing vertically into the second forming collar and tube at 62, where material from reel 5A is formed around the collar 62 and pulled or driven down the outer tube, for example by means of a moving belt or reciprocating jaws 63, with a fin or lap back seal being applied at 56 in any suitable position. The back seal is applied only to the outer material, with the inner pouch being in free suspension at this stage. The outer bag is then inflated with an overpressure of either air or a combination of gases, such as carbon dioxide or nitrogen, before the end seals are applied at 57. This sealing station also seals the inner pouch to the outer bag before being cut at 57 and dropping onto a supporting conveyor (not shown), with the finished packages being indicated at 58 (see also FIG. 1).

Figure 7:
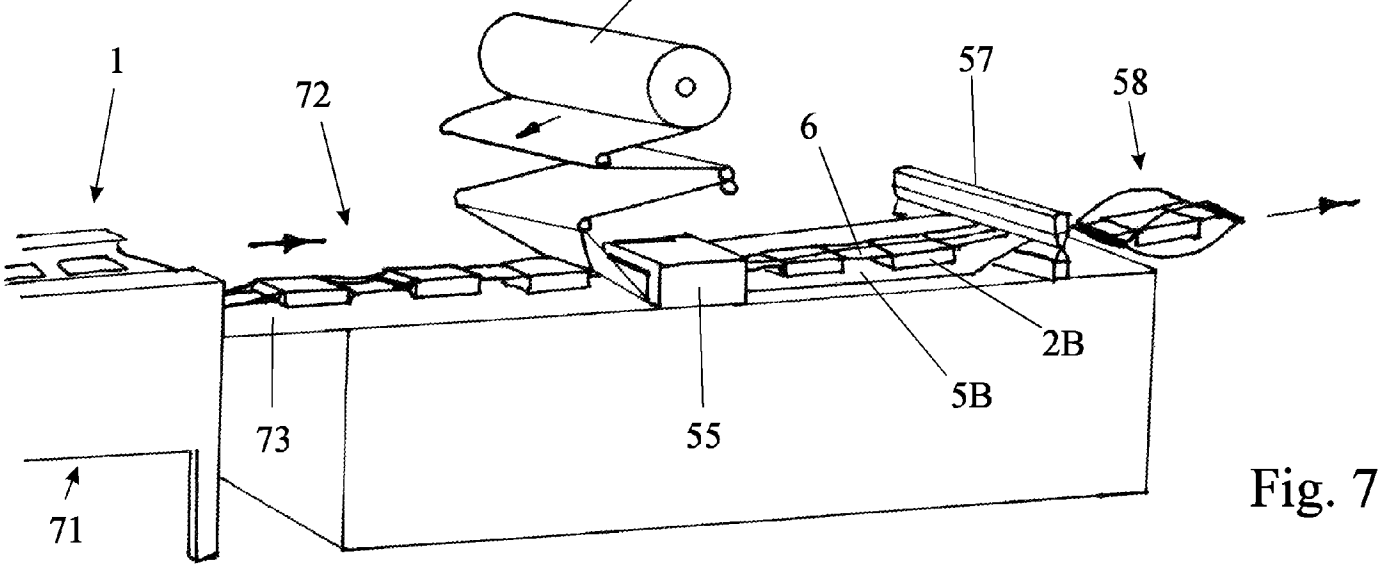
FIG. 7 shows as a schematic a machine adaptation wherein a conventional vacuum forming machine operates in tandem with a horizontal form fill and seal machine to produce the package shown in FIG. 2.

In FIG. 7, 1 indicates the product gently restrained or held in a soft or hard vacuum after the sealing station on a conventional vacuum forming machine 71 where a base web has been formed to accommodate the product and then a top web is sealed to the base web around the product. At vacuum forming machine 71, a top and base web has been used in conventional manner to encase the product with side and end seals sealing the top to the base web around the pouch, that may have been gas flushed with a mixture of gases before sealing. 72 indicates the uncut inner sealed packs continuing on a supporting conveyor 73 before entering a horizontal form fill and seal machine, with an outer material 5A being formed around the inner pack at forming station 55. A fin or lap back seal 6 is then applied by either heated rollers or heated pads (not shown) to produce a back seal which seals the outer material 5A only to itself. The back seal 6 is not attached to the inner pouch. 2B shows the inner pouch still held in suspension within the outer wrap and 5B the outer bag inflated with either air or a mixture of gases, such as carbon dioxide or nitrogen. The outer bag is then sealed as shown at 57, with the inner and outer bags also being sealed together at 57 before being cut into individual packs. 58 indicates the finished individual packs leaving the production machine (see also FIG. 2).

An alternative embodiment of the invention is shown in FIGS. 8 and 9, which differs from that shown in FIG. 1 only in that that material of the outer bag 5 is pinched at four locations and welded to form four reinforced lines extending along the length of the outer bag. Because of these welded reinforcements, when the bag is inflated, the cross section shown in FIG. 8 has four cusps so that the shape of the outer bag is not a smooth ellipse but approximates more to a rectangle. This improves the stackability of the packages.

In FIG. 8, the product 1 is shown in end profile held within the inner pouch 2 which is sealed by a lap or find seam 3. 5 The outer wrap bag 5 in this embodiment has four welded pinches which define four corner cusps 80. The outer bag is shown with a back seal 6 of the same construction as described in the previous embodiments but in this case it is alternatively possible for the seal to acts as, or to be incorporated into, one of the cusps as shown at 6' in the FIG. 8.

FIG. 9 shows another profile of the same packaging demonstrating the manner in which the product 1 is restrained from moving in the inner pouch 2 by means of the seals 4. FIG. 9 also shows the outer bag 5 with the pinched longitudinal cusps 80. The outer pack end seals 7 seal the material of the outer bag 5 to that of the inner pouch 2 to suspend the article 1 in the bag.

FIG. 10 indicates how the inclusion of the cusps 80 approximates the outer pack into more of a rectangular shape.

While the description and drawings relate to the formation of an inner pouch, it should not be considered an essential part of the invention. The essential feature is that the inner web supporting the article or product is trapped within the end seals of the outer bag, and maintained in tension. The tension serves to suspend the inner web (or pouch) relative to the inflated outer bag.

The invention claimed is:

1. A method of packaging an article comprising:

a. forming an inner pouch around the article by wrapping material of a web around the article and forming a back seal from edges of the web;

b. forming an outer tube around the pouch by wrapping a film around the pouch and forming a back seal from edges of the film;

c. gas-inflating the annular region outside of the inner pouch and within the outer tube; and d. forming respective transverse seals on opposite longitudinal ends of both the pouch and the tube so as to (i) seal and encapsulate the article within the pouch and (ii) transform the outer tube into a gas-inflated bag around the article-containing pouch, the transverse seal formed in the outer tube serving to secure the inner pouch to the outer bag, wherein the method is performed such that (A) the pouch is tensioned by the pressure within the outer bag to suspend the article-containing pouch within the gas-inflated outer bag and to maintain a space between the article-containing pouch and the outer bag on all sides of the article; and (B) the back seal closing the inner pouch is laterally offset from the back seal closing the outer bag.

2. The method of claim 1 wherein at a time of the gas-inflating, the inner pouch is gas-sealed from the annular region outside of the inner pouch and within the outer tube.

3. The method of claim 2 performed so that the inner pouch and the outer bag are sealed to each other laterally along the transverse seals that are disposed on the longitudinally-opposite ends of the inner pouch.

4. The method of claim 2 performed so that the inner pouch and the outer bag are attached to each other without forming a longitudinal seal therebetween.

5. The method of claim 1 wherein the gas-inflating of the annular region does not collapse the inner pouch.

6. The method of claim 1, performed by a horizontal form fill and seal machine.

7. The method of claim 1 performed on first and second articles to respectively form i) first and second inner pouches; and (ii) first and second outer bag, around the first and second articles wherein: (A) the first and second inner pouches are each formed from a common web material; (B) the first and second outer bags are each formed around the first and second inner pouches at a time when the first and second inner pouches are connected to each other by the common web material.

8. The method of claim 7 wherein the first and second inner pouches and outer bags respectively define first and second annular regions, each of which are gas-inflated at a time when the first and second inner pouches are connected to each other by the common web material.

9. The method of claim 7 performed so that the inner pouch and the outer bag are sealed to each other laterally along the transverse seals that are disposed on the longitudinally-opposite ends of the inner pouch.

10. The method of claim 7 performed so that the inner pouch and the outer bag are attached to each other without forming a longitudinal seal therebetween.

11. The method of claim 1 performed so that the inner pouch and the outer bag are sealed to each other laterally along the transverse seals that are disposed on the longitudinally-opposite ends of the inner pouch.

12. The method of claim 1 performed so that the inner pouch and the outer bag are attached to each other without forming a longitudinal seal therebetween.

13. The method of claim 1 wherein the inner pouch is connected to the outer bag only by the transverse seals on longitudinal opposite ends of the inner pouch.

14. The method of claim 1 wherein the article is a solid article.

15. The method of claim 14, performed so that when the inner pouch is formed around the solid article so that a majority of an interior of the inner pouch is occupied by the solid article.

16. The method of claim 1 performed so that the outer bag has a plurality of welded pinches defining a plurality of longitudinally extending cusps disposed around the inner pouch.

17. The method of claim 1 performed so that the outer bag has a plurality of welded pinches defining a plurality of longitudinally extending cusps disposed around the inner pouch and extending normal to a plane in which the outer bag is spaced from the inner pouch about its entire circumference.

18. The method of claim 1 performed so that the outer bag has at least four welded pinches which define four corner cusps of the outer bag.

19. The method of claim 18 performed so that the back seal of the outer bag lies within one of the cusps.

20. The method of claim 1 wherein the inner pouch is a vacuum pack.

21. The method of claim 1 wherein an inert gas is introduced into an interior of the inner pouch to replace the oxygen within the interior of the inner pouch.

* * * * *